US010458734B2

(12) United States Patent
Faxon

(10) Patent No.: US 10,458,734 B2
(45) Date of Patent: Oct. 29, 2019

(54) MATCHED FIREARM RECEIVER AND METHOD OF MANUFACTURE

(71) Applicant: Robert T. Faxon, Cincinnati, OH (US)

(72) Inventor: Robert T. Faxon, Cincinnati, OH (US)

( * ) Notice: Subject to any disclaimer, the term of this patent is extended or adjusted under 35 U.S.C. 154(b) by 164 days.

(21) Appl. No.: 15/267,739

(22) Filed: Sep. 16, 2016

(65) Prior Publication Data

US 2017/0227309 A1 Aug. 10, 2017

Related U.S. Application Data

(60) Provisional application No. 62/219,353, filed on Sep. 16, 2015.

(51) Int. Cl.
*F41A 3/66* (2006.01)
*F41A 11/00* (2006.01)

(52) U.S. Cl.
CPC ..... *F41A 3/66* (2013.01); *F41A 11/00* (2013.01)

(58) Field of Classification Search
CPC ..... F41A 3/66; F41A 11/00; F41A 11/02
See application file for complete search history.

(56) References Cited

U.S. PATENT DOCUMENTS

| | | | | |
|---|---|---|---|---|
| 3,831,048 | A * | 8/1974 | Wagner | F16C 33/20 310/90 |
| 4,164,825 | A * | 8/1979 | Hutchison | F41C 23/06 42/1.06 |
| 4,867,037 | A * | 9/1989 | Smith | F41A 27/20 89/41.01 |
| 9,459,060 | B2 * | 10/2016 | Langevin | F41A 3/66 |
| 2015/0276335 | A1 * | 10/2015 | Daley, Jr. | F41A 3/66 42/75.01 |
| 2016/0091026 | A1 * | 3/2016 | Dittmar | F16D 3/41 464/131 |

* cited by examiner

*Primary Examiner* — J. Woodrow Eldred
(74) *Attorney, Agent, or Firm* — Wood Herron & Evans LLP

(57) ABSTRACT

The present invention provides matched upper and lower firearm receivers and method of manufacturing the same. An upper receiver has a forward lug and a rear lug. A lower receiver has forward ears and rear sidewalls that form a pocket. When the upper and lower receivers are positioned together, the forward lug fits between the lower receiver ears and the rear lug fits into the pocket between the sidewalls. Forward openings are formed in axial alignment through the ears and forward lug. Rear openings are formed in axial alignment through the rear sidewalls and the rear lug. Reinforcement sleeves are fitted into the forward openings of the ears and forward lug and into the rear openings of the sidewalls and rear lug.

6 Claims, 5 Drawing Sheets

MATCHED FIREARM RECEIVER AND METHOD OF MANUFACTURE

RELATED APPLICATION

This application claims the benefit of U.S. Provisional Patent Application No. 62/219,353 filed Sep. 16, 2015, the disclosure of which is incorporated herein by reference.

FIELD OF THE INVENTION

This invention relates to the "matching" of a firearm upper and lower receiver and method of manufacturing the same. More particularly, it relates to the use of sleeves to reinforce and provide precise alignment of the take-down and pivot pin openings, particularly for an AR15-platform firearm.

BACKGROUND OF THE INVENTION

AR15-platform firearms comprise separable upper and lower receivers. The lower receiver houses the trigger mechanism and the upper receiver houses the bolt carrier group. The upper and lower receivers are attached together by a pair of slidable attachment pins. The rear pin can be removed, allowing the upper and lower receivers to pivot relative to one another on the forward pin. The forward pin may also be removed in order to completely separate the upper and lower receivers. Typically, the attachment pins are captured on the lower receiver to prevent loss when the receiver parts are disconnected.

The ability to customize and accessorize the AR15- and AR10-platform has contributed to its overwhelming popularity. The platform is relatively easy to assemble from parts and many users choose to assemble an AR15-platform firearm on their own, allowing them to select exactly which parts, components and features they wish to include. The lower receiver is considered to be the "firearm" and regulated under US law, while the other parts may be purchased and manufactured with relatively broad freedom. The upper and lower receivers may be milled from a forged blank or may be completely milled from a billet of material, usually an aluminum alloy. Published MIL-SPEC standards are typically followed to assure that any standard upper receiver will functionally mate to any standard lower receiver by insertion of the two attachment pins through openings formed in the lower receiver that correspond to openings in attachment lugs on the upper receiver.

Despite following standard specifications, the "fit" between an upper and lower receiver can be imperfect. Some manufacturers intentionally design the fit of their upper and/or lower receiver to have a small gap between the parts when they are assembled in order to allow for manufacturing variances. This gap is considered unsightly by some users, an indication of overly large manufacturing tolerances, or may even result in a lose fit between the upper and lower receiver, allowing movement and rattle to occur. Some manufacturers produce and sell "matched" upper and lower receiver sets, which have been either hand selected for fit or have been drilled to provide an exact fit, at the risk of non-compliance with standard specifications and loss of the ability to universally fit one of the matched pair to any other "standard" receiver.

Although firearms assembled from mill-spec upper and lower receivers have proved to be quite durable, even in combat use, some users are concerned about wear occurring as steel attachment pins are pressed into and removed from the attachment openings in the aluminum upper and lower receivers.

SUMMARY OF THE INVENTION

The present invention provides matched upper and lower firearm receivers. An upper receiver has a forward lug and a rear lug. A lower receiver has forward ears and rear sidewalls that form a pocket. When the upper and lower receivers are positioned together, the forward lug fits between the lower receiver ears and the rear lug fits into the pocket between the sidewalls. Forward openings are formed in axial alignment through the ears and forward lug. Rear openings are formed in axial alignment through the rear sidewalls and the rear lug. Reinforcement sleeves are fitted into the forward openings of the ears and forward lug and into the rear openings of the sidewalls and rear lug.

The invention also provides a method of manufacturing matched upper and lower firearm receiver sets. An upper receiver having a forward lug and a rear lug is provided. A lower receiver having forward ears and rear sidewalls that form a pocket is provided. The upper and lower receivers are positioned together with the forward lug between the lower receiver ears and the rear lug in the pocket between the sidewalls. Forward openings are formed in axial alignment through the ears and forward lug. Rear openings are formed in axial alignment through the rear sidewalls and the rear lug. Reinforcement sleeves are inserted into the forward openings of the ears and forward lug and into the rear openings of the sidewalls and rear lug.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWING

Like reference numerals are used to indicate like parts throughout the various figures of the drawing, wherein.

DETAILED DESCRIPTION OF THE INVENTION

Figure 1:
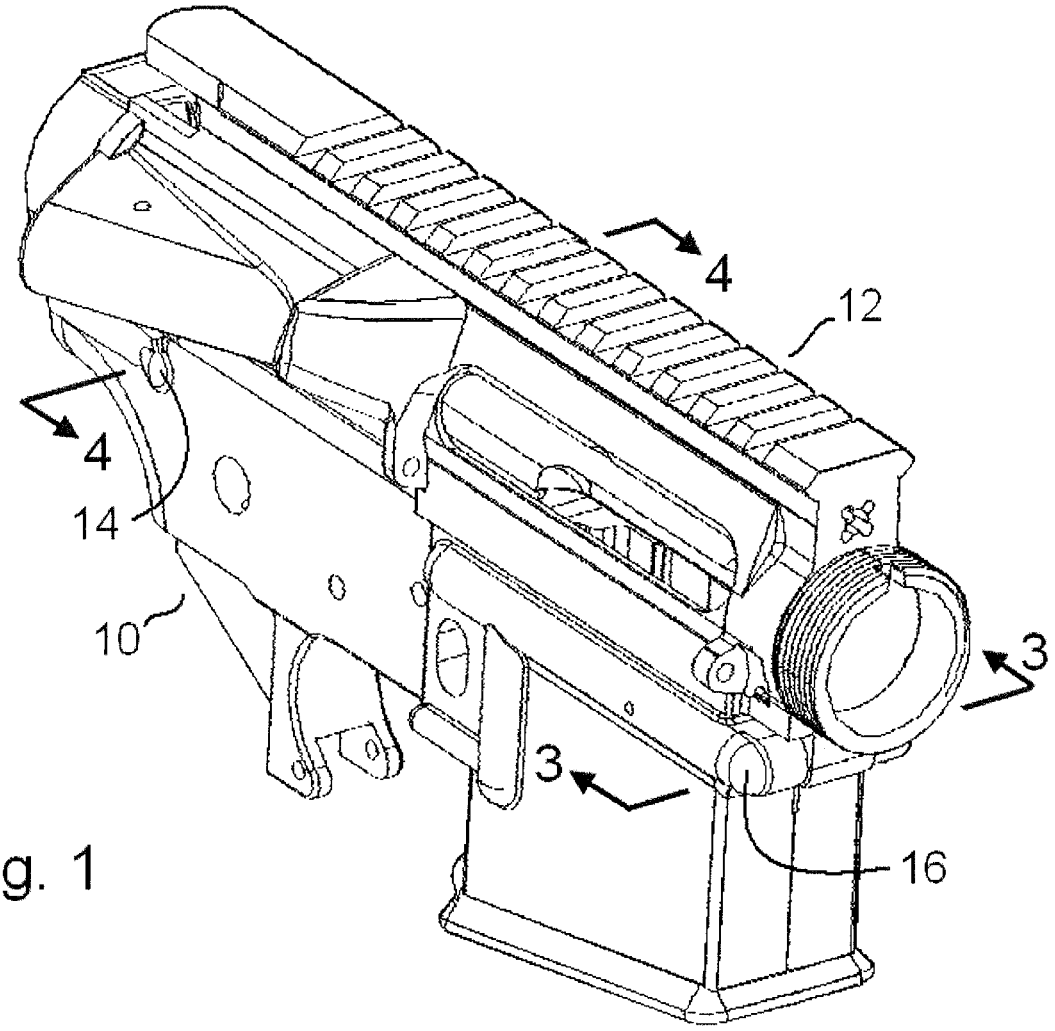
FIG. 1 is an isometric view of a stripped upper and lower receiver set assembled according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
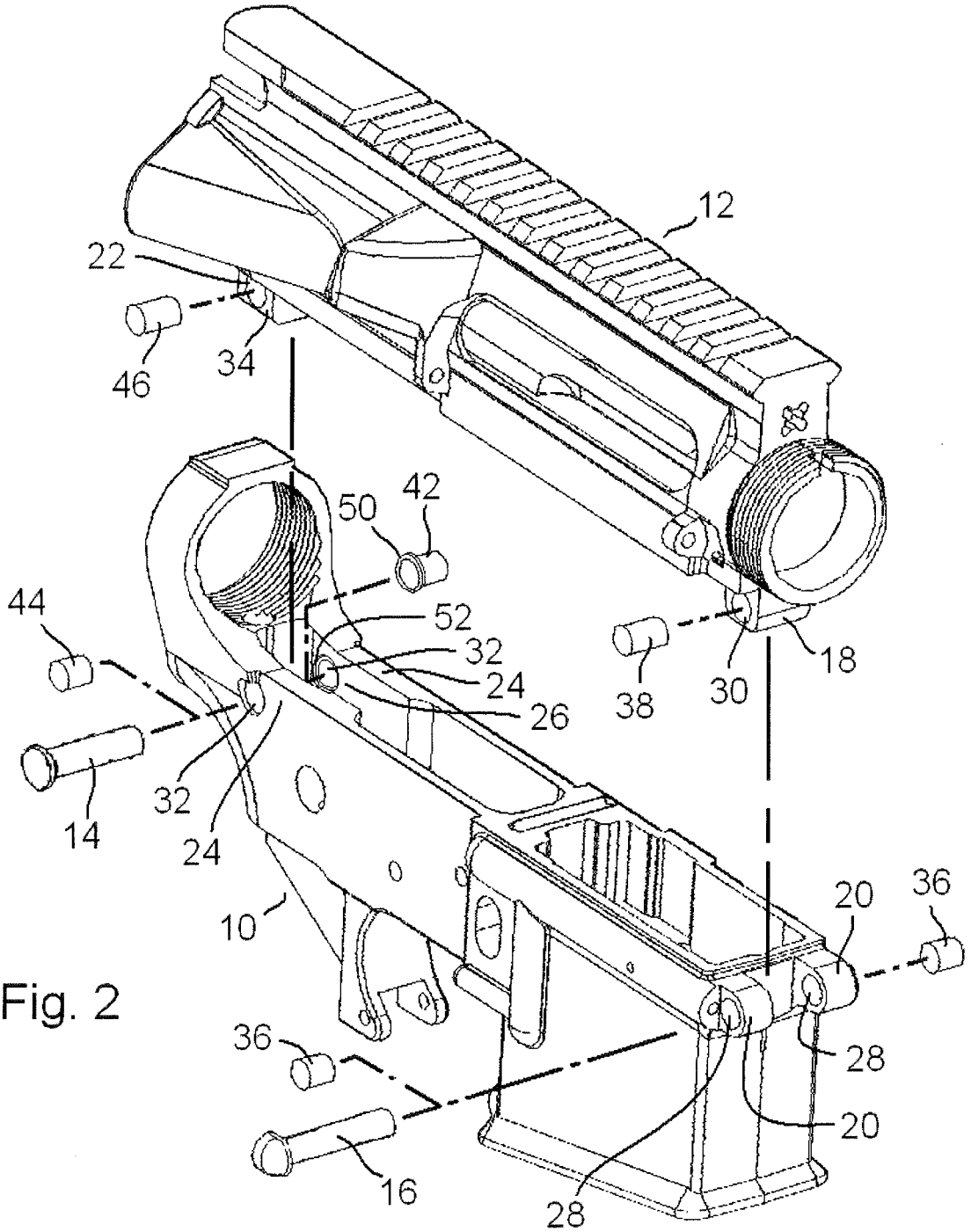
FIG. 2 is an exploded isometric view thereof.

Referring now to the various figures of the drawings, and first to FIGS. 1 and 2, therein is shown a matched lower receiver 10 and upper receiver 12 set according to one embodiment of the present invention. The illustrated receivers 10, 12 are otherwise those of an ordinary AR-pattern firearm. The present invention is not restricted only to the AR15/AR10platform; however, it is intended for firearms in which upper and lower receiver parts are separable by the user simply by movement or removal of attachment pins, as further described below.

The upper and lower receivers 10, 12 are shown "stripped" (without any of the other parts required for operation installed), except for the rear take-down pin 14 and front pivot pin 16. In a typical AR-pattern firearm, the upper receiver 12 includes a forward lug 18 that fits between laterally spaced apart forward mounting portions or ears 20 on the lower receiver 10 and a rear lug 22 that fits between laterally spaced apart rear mounting portions or sidewalls 24 of the lower receiver pocket 26. When the upper receiver 12 and lower receiver 10 are moved together, openings 28 in the ears 20 are axially aligned with an opening 30 in the forward lug 18 and openings 32 in the sidewalls 24 of the lower receiver 10 are axially aligned with an opening 34 in the rear lug 22. The front pivot pin 16 may then be inserted through forward openings 28, 30 and the rear take-down pin 14 may be inserted through the rear openings 32, 34, joining the lower and upper receiver parts 10, 12 together. According to standard (MIL-SPEC or commercial) specifications, the rear take-down pin 14 and front pivot pin 16 are captured onto the lower receiver 10 by detents (40, 48, not shown in FIGS. 1 and 2) so that the pins 14, 16 are not completely removed or separated from the lower receiver 10 when disengaged from the lugs 18, 22 of the upper receiver 12.

Typically, a user will assemble the lower receiver 10 to the upper receiver 12 by first engaging the front pivot pin 16 through the openings 28 of the ears 20 and opening 30 of the forward lug 18 before engaging the rear take-down pin 14 with the openings 32 in the receiver wall 24 and the opening 34 in the rear lug 22. Conversely, when disassembling the upper receiver 12 from the lower receiver 10, a user will often first disengage the rear take-down pin 14, allowing the lower and upper receiver parts 10, 12 to pivot relative to each other on the front pivot pin 16 instead of or prior to complete separation of the receiver parts 10, 12. Alternatively, the receivers 10, 12 may be positioned together before inserting both pins 14, 16 in either order, or the pins 14, 16 may be disengaged in either order before separating the receiver parts 10, 12.

Figure 3:
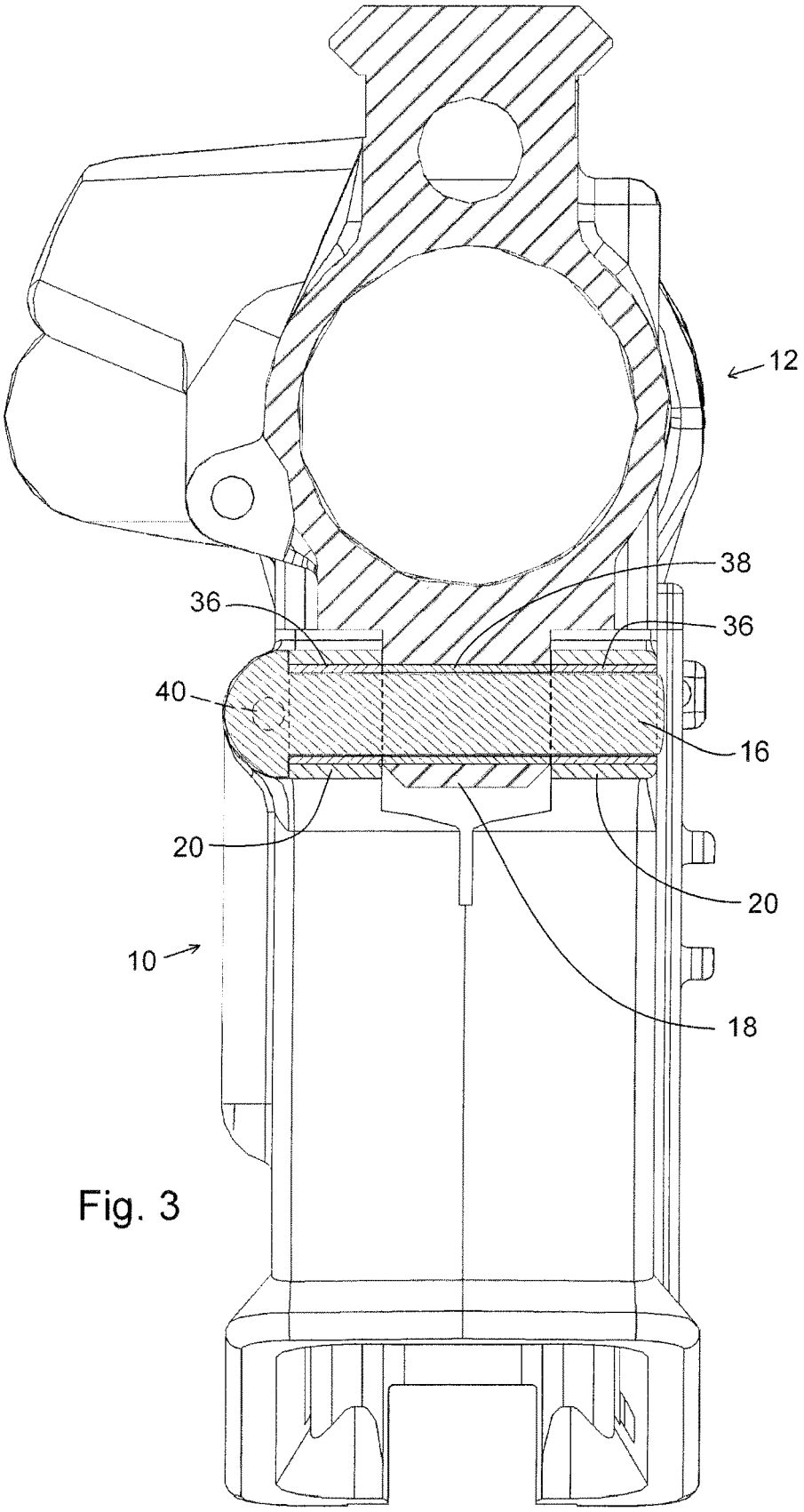
FIG. 3 is a cross-sectional view taken substantially along line 3-3 of FIG. 1.
Figure 4:
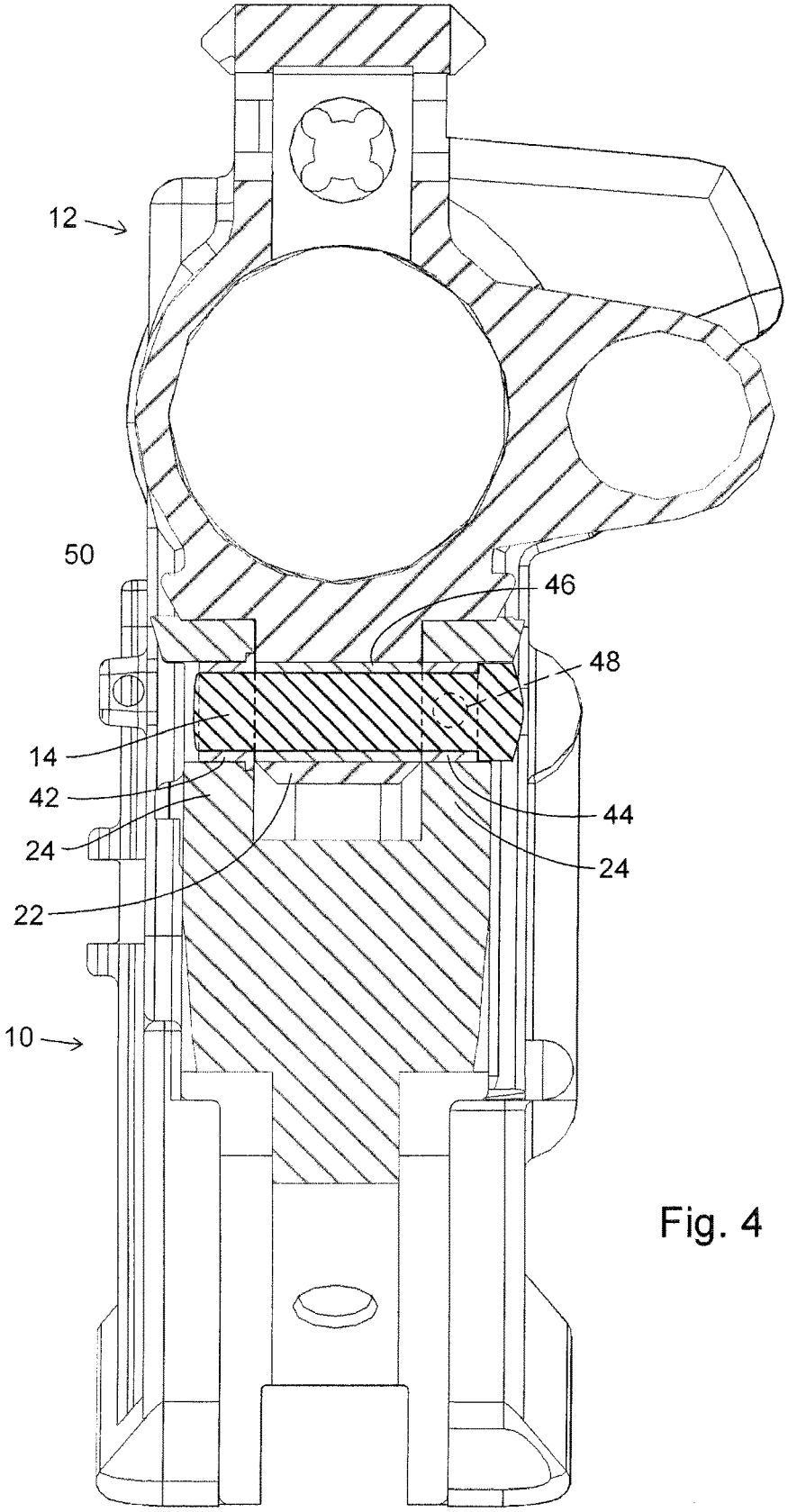
FIG. 4 is a cross-sectional view taken substantially along line 4-4 of FIG. 1.
Figure 5:
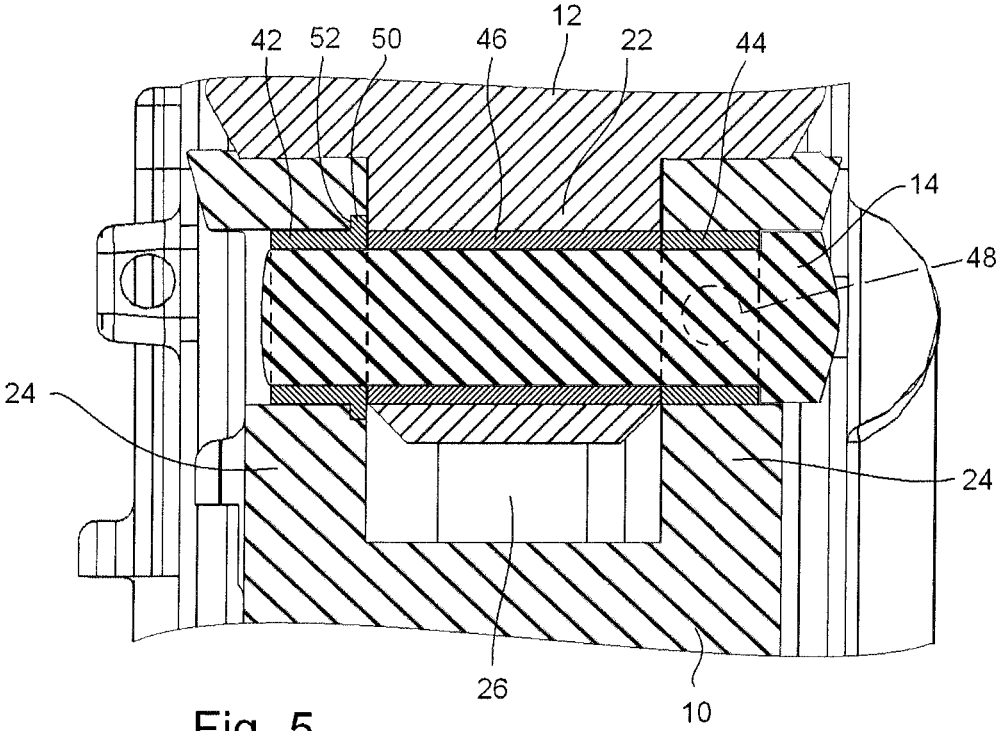
FIG. 5 is an enlarged fragmentary cross-sectional view of the rear connection shown in FIG. 4.

Referring now also to FIGS. 3-5, the present invention provides matched receivers 10, 12 and a method of manufacturing matched receivers either by the original manufacturer or for retrofit. The invention includes placing an upper receiver 12 and a lower receiver 10 together, and then drilling aligned, oversized openings that correspond to the assembly pin openings 28, 30, 32, 34 in both members 10, 12 at the same time. This oversized drilling may be done on receiver blanks in which no prior assembly pin openings have been formed or on receiver parts 10, 12 in which standard-sized openings have already been formed.

The co-drilling of the receiver members 10, 12 assures exact axial alignment of the openings 28, 30, 32, 34. According to the present invention, as described in more detail below, the oversized holes are then lined with sleeves or bushings 36, 38, 42, 44, 46, preferably of a harder material, such as steel. The bushings 36, 38, 42, 44, 46 may be made with an outside diameter that closely matches that of the oversized holes so that they can be firmly secured therein. Attachment of the bushings 36, 38, 42, 44, 46 to the receiver parts 10, 12 may be accomplished by various means, such as by press fit, brazing, adhesive, with splines, or by thermal shrink fitting. The inside diameter of the bushings 36, 38, 42, 44, 46 may be precisely formed to preselected diameter(s) for use with standard sized attachment pins 14, 16, or to a non-standard size, and will be precisely aligned when installed.

Referring now in particular to FIG. 3, separate bushings 36 may be installed in the mounting ears 20 of the lower receiver 10 and another bushing 38 may be installed in the forward lug 18 of the upper receiver 12. The pivot pin 16, captive on the lower receiver 10 by a standard detent (the location of which is shown in phantom line at 40) may be inserted through the respective bushings 36, 38 to secure the upper receiver 12 to the lower receiver 10 for pivotal attachment thereto.

Referring now to FIG. 4, separate bushings 42, 44 may be inserted through the walls 24 of the lower receiver 10 and another bushing 46 may be inserted in the attachment lug 22 of the upper receiver 12. A take-down pin 14 may then be passed through the respective bushings 42, 44, 46 to secure the upper receiver 12 to the lower receiver 10. The standard detent (the location of which is shown in phantom line at 48) for capturing the take-down pin 14 on the lower receiver 12 would extend through the right side lower bushing 44, typically requiring an opening to be formed therein after installation of the bushing 44.

According to another embodiment of the invention, the left lower rear bushing 42 may be formed with an outwardly extending flange 50 and the opening may be formed with an annular recess 52 on the inner side of the pocket sidewall 24. The flange 50 can mechanically interlock the bushing 42 in place and prevent displacement of the bushing 42 as the take-down pin 14 is forced into place. As the upper receiver 12 is usually assembled onto a lower receiver 10 first with the forward pivot pin 16, the parts can be manipulated and adjusted to allow smooth insertion of the pivot pin 16 without undo lateral or skewed forces on the bushings 36, 38. However, that is not always the case for the rear take-down pin 14 when it is inserted second. Although the present invention is intended to minimize any misalignment of the rear openings 32, 34, if the user has not properly seated the upper receiver 12 onto the lower receiver 10, lateral forces tending to displace the rear upper bushing 46 and rear left lower bushing 42 are possible if the pin 14 is forced or hammered into place. Displacement of the rear upper bushing 46 can be backed, and displacement prevented, by the left rear lower bushing 42. The left rear lower bushing 42, however, would be held only by the sheer contact friction or bond between its outer surface and the inner surface of the oversized opening 32 formed in the sidewall 24 of the lower receiver 10. Providing either an outwardly extending flange 50 at the inner end of the bushing 42 or providing an annular face (not shown) at the outer end of the oversized opening 32 to mechanically block displacement of the bushing 42 will eliminate this risk.

Figure 6:
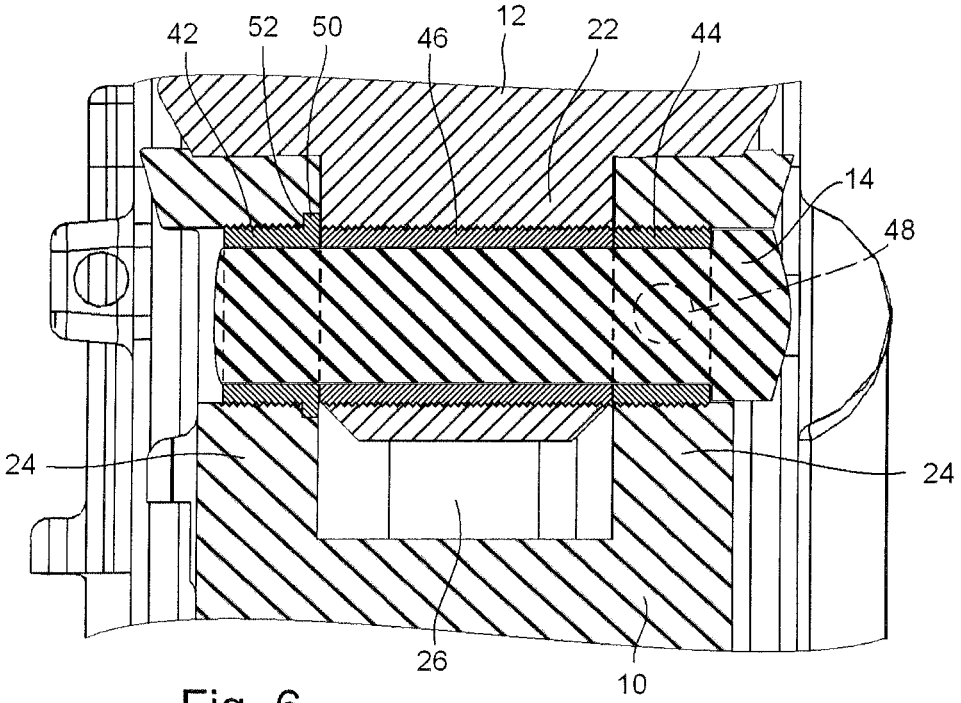
FIG. 6 is a view similar to FIG. 5 showing an alternate embodiment.

Referring now to FIG. 6, according to an alternate embodiment of the invention, after drilling or reaming, as described above, the openings 28, 30, 32, 34 could be threaded. The bushings 42, 44, 46 (and 36, 38, not shown in FIG. 6) could be provided with corresponding exterior threads as an alternate means for securing the bushing in place. This threaded attachment could be used with or without the flange 50, described above. For turning the threaded bushings 36, 38, 42, 44, 46, notches (not shown) or other tool engagement means could be provided at one or both axial ends.

According to an alternate method of manufacturing the present invention, bushings 36, 38, 42, 44, 46 could be formed with undersized inner openings and drilled or reamed concurrently to a finished inside diameter after installation.

While certain embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A method of manufacturing matched upper and lower firearm receiver sets, comprising the steps of:

providing a first receiver part having a forward lug and a rear lug; providing a second receiver part having laterally spaced apart forward mounting portions and laterally spaced apart rear mounting portions;

positioning the first and second receiver parts together with the forward lug between the forward mounting portions and the rear lug between the rear mounting portions;

forming forward openings that are sized larger than a first preselected desired finished diameter in axial alignment concurrently through the forward mounting portions and forward lug;

forming rear openings that are sized larger than a second preselected desired finished diameter in axial alignment concurrently through the rear mounting portions and the rear lug; and inserting reinforcement sleeves having the first preselected desired finished interior diameter into the openings of the forward mounting portions and forward lug and having the second preselected desired finished interior diameter into the openings of the rear mounting portions and rear lug, the sleeves receiving removable assembly pins to secure the upper and lower receivers together.

2. The method of claim 1, wherein the sleeves are press fit into the openings.

3. The method of claim 1, wherein the sleeves are shrink fit into the openings.

4. The method of claim 1, comprising the further steps of threading the forward and rear openings, providing corresponding external threads on the sleeves, and threading the sleeves into the openings.

5. The method of claim 1, comprising the further step of providing at least one of the sleeves with an annular flange.

6. The method of claim 1, wherein the reinforcement sleeves of the forward mounting portions and forward lug are reamed concurrently to a first finished inside diameter after installation and the reinforcement sleeves of the rear mounting portions and rear lug are reamed concurrently to a second finished inside diameter.

* * * * *